US008683757B2

(12) United States Patent
D'Ancona

(10) Patent No.: US 8,683,757 B2
(45) Date of Patent: Apr. 1, 2014

(54) PROTECTION CELL

(76) Inventor: Nicola D'Ancona, Campobasso (IT)

( * ) Notice: Subject to any disclaimer, the term of this patent is extended or adjusted under 35 U.S.C. 154(b) by 0 days.

(21) Appl. No.: 13/634,280

(22) PCT Filed: Mar. 11, 2011

(86) PCT No.: PCT/IB2011/000532
§ 371 (c)(1), (2), (4) Date: Sep. 12, 2012

(87) PCT Pub. No.: WO2011/110942
PCT Pub. Date: Sep. 15, 2011

(65) Prior Publication Data

US 2013/0000225 A1 Jan. 3, 2013

(30) Foreign Application Priority Data

Mar. 12, 2010 (IT) ..... PI2010A0027

(51) Int. Cl.
*E04B 1/98* (2006.01)

(52) U.S. Cl.
USPC ..... 52/167.1; 52/169.6

(58) Field of Classification Search
USPC ..... 52/167.1, 169.6, 79.1; 109/1 S; 312/239, 312/307, 334.14
See application file for complete search history.

(56) References Cited

U.S. PATENT DOCUMENTS

| | | | | |
|---|---|---|---|---|
| 6,349,508 | B1 * | 2/2002 | Ju et al. | 52/79.1 |
| 6,539,674 | B2 * | 4/2003 | Arnold | 52/79.1 |
| 7,690,159 | B1 * | 4/2010 | Arnold | 52/167.1 |
| 2012/0079968 | A1 * | 4/2012 | von Bereghy | 109/1 S |

FOREIGN PATENT DOCUMENTS

| | | |
|---|---|---|
| CN | 201210972 | 3/2009 |
| CN | 201226987 | 4/2009 |
| CN | 201227483 | 4/2009 |
| CN | 201243766 | 5/2009 |
| JP | 11099217 | 4/1999 |
| JP | 2000023753 | 1/2000 |
| JP | 2003310776 | 11/2003 |
| JP | 2007125282 | 5/2007 |

* cited by examiner

*Primary Examiner* — Jeanette E Chapman
*Assistant Examiner* — Daniel Kenny
(74) *Attorney, Agent, or Firm* — Ladas & Parry LLP

(57) ABSTRACT

A protection cell having an upper wall and a lower wall spaced with respect to each other through a plurality of side walls integrally connected to each other, to form an open box-like container with an entrance opening. The container defines inside a shelter space arranged to accommodate a user. In particular, the container is produced as a single block that reproduces the open box-like container. The anti-seismic cell has a movable wall portion mounted slidingly on the box-like container, by means of a sliding cooperating element, in particular a plane sliding board that slidingly engages between at least two slide paths, which are arranged at opposite sides with respect to each other. The plane sliding boards allows movable wall portion to move from an open configuration to a closed configuration, where the movable wall portion blocks the opening defining the protection cell.

22 Claims, 13 Drawing Sheets

100
1
4
A
40
43
10
43
60
43
20
3
43
2
22
10a
11
15
25

150
A
10
1
20
22
A
3
25
10a
2
15

23a
23
7
20
9

7
20
4a
100
10
1
70
22
3
25
70
2
10a
60

40
44
43
41
42

1
100
70
22
10
4
20
70
4a
3
60
2
11
25
15

PROTECTION CELL

This application is a 371 of PCT/IB2011/000532, filed on Mar. 11, 2011, which claims priority to Italian patent application number PI2010A000027, filed Mar. 12, 2010, which is incorporated herein by reference.

FIELD OF THE INVENTION

The present invention relates to a protection cell made in the form of a table, bed, lifeboat or other similar structure, capable to protect a user and to assist rescue in case of earthquake phenomena or disasters of other kind. In particular, this structure can be used in public and private schools, offices, to conference rooms, railway stations, libraries, churches, hospitals, watercrafts, aircrafts etc.

BACKGROUND OF THE INVENTION

A need is felt to minimize risks during and after catastrophic events such as earthquakes, floods or weather disasters, especially in crowded places is such as those above described.

During an earthquake, a fall of material, a partial or total collapse of structures, break of glasses and windows, fall of closets, furniture or other objects, are in most cases the reason of casualties.

As well known, in the last years buildings or houses of new conception have been built, in industrialized countries, with anti-seismic criteria. However, many regions in the world are particularly exposed to earthquakes and have insufficiently protected buildings, as well as furniture and objects in the buildings are free of moving and are not enough fixed to the buildings. So, where the buildings are old or in any case not adapted to bear the thrusts of earthquakes, since it is not possible, in the short time, to replace or reinforce the buildings with anti-seismic criteria, it is however possible to modify the objects, tables, beds, chairs, shelves, etc. (since they can be reason of casualties). Such aspect becomes of particular importance in public places such as public and private schools, offices, conference rooms, railway stations etc., wherein many people can be present. Even the anti-seismic structures, on the other hand, are capable of resisting in case of earthquake phenomena only up to a certain intensity, normally magnitude 7, whereas for extremely strong earthquakes they can also suffer serious damages.

Anti-seismic protection structures are known in the form of tables, beds and of other kind, which appear as furnishing in a building, in an office, in a school etc.

The most common types show a school or office desk of different size as described for example in JP2003310776A, CN201226987Y or in CN201210972Y, comprising an upper plane held with uprights of steel or wood or by a reticular open structure. The same structure that bears the desk defines a space within which at least one people can shelter in case of earthquake. Such structure provides, furthermore, in the shelter space, a kit of tools that can comprise for example a torch, a fire extinguisher or other tools, as described in CN201227483Y or in CN201243766Y.

As above said, however, the space located under the upper table desk is protected laterally only by uprights or by a reticular structure, and fragments of walls, objects or other debris can reach the user under the table shelter space.

This drawback is faced by other anti-seismic structures, as disclosed in JP11099217A, which have a box-like shape. In this case, an inner support frame is present that bears a plurality of boards arranged to cover it. Through an access door hinged to the structure, a user can access inside.

Such structure, however, has some drawbacks. Firstly, the access door, removable or hinged to the box-like structure at the aperture, is in the former case difficult to open/close quickly in case of need, whereas in the latter case it is always necessary to provide at least one hinged edge that reduces remarkably the size of the entrance and can block the user when entering quickly in the box-like structure.

Furthermore, such box-like structures do not ensure a fluid tight shelter space. Such causes gas, fluids or dust, formed by the collapse of walls or floors, to leak into the shelter space causing high risk on the safety of the user.

On the other hand, protection cells capable of protecting people in case of tsunami, landslide or flood disasters do not exist.

SUMMARY OF THE INVENTION

It is therefore a feature of the present invention to provide a protection cell that is structurally strong, but in the meantime light and handy, which can reduce casualties in disasters such as earthquakes, landslides, structural collapses, wars, as well as railway, car and aircraft crashes.

It is also a feature of the present invention to provide a protection cell which is made in an air-tight way, in order to give protection also against gas and powder.

Is also a feature of the present invention to provide a protection cell which is made in a liquid-tight way, in order to give protection also in case of tsunami, floods, shipwrecks.

Is also a feature of the present invention to provide a protection cell which is easy to use and cheap to manufacture on an industrial scale.

It is also a feature of the present invention to provide a protection cell which can ensure functionality in different conditions and that can be quickly retrieved by rescuers.

These and other objects are achieved by a protection cell comprising:

- a lower wall;
- an upper wall at a distance from said lower wall;
- a plurality of side walls integrally connected to each other and arranged between said upper wall and said lower wall, in order to form substantially a open box-like container comprising at least one opening obtained at one of said walls, said box-like container defining a inner shelter space that is arranged to accommodate at least one user;
- at least one movable wall portion cooperating with said open box-like container and that is arranged to block said opening,
- wherein said movable wall portion is mounted slidingly on said box-like container by means of a sliding cooperating element arranged substantially orthogonal to said movable wall portion.

In particular, said container is produced as a single block with the shape of said open box-like container, which defines the inner shelter space for receiving the user.

In particular, said sliding cooperating element is arranged to engage with at least one slide path mounted on said upper wall or lower wall or on at least one side wall of said box-like container, such that the box-like container and the movable wall portion are adapted to move from an open configuration, where the movable wall portion opens said opening, to a closed configuration, where said movable wall portion blocks said opening, defining said protection cell.

This way, by the sliding cooperating element the movable wall portion remains always connected to the box-like container, such that the opening is closed quickly and easily in case of calamity such as an earthquake.

Preferably, said sliding cooperating element is a sliding plane board integral to said movable wall portion that slidingly engages between at least two guides, which are arranged at opposite sides with respect to each other on said box-like container.

Preferably, said slide path is arranged on said lower wall such that said sliding plane board faces towards the above or below with respect to said lower wall of said protection cell. In particular, this exemplary embodiment forms a structure substantially "drawer-like" where the movable wall portion remains always connected to the box-like container by the sliding plane board. This way, a quick closure of the movable wall portion is assisted. Furthermore, is in the open configuration the entrance space for the user to access the shelter space is wider with respect to, for example, an opening where the movable wall is hinged to the side wall. In this case, in fact, side edges for making the hinges would be necessary that reduce the size of the opening and create an obstacle to the entrance of the user.

Advantageously, at said opening a sealing means is provided adapted to ensure a fluid tight engagement of said box-like container in said closed configuration. This way, the protection cell prevents dust, liquid or gas, from leaking into the shelter space, ensuring a total protection to the user.

In particular, said sealing means comprises at least one groove, in particular a groove with tapered cross section, that is arranged to couple with a respective sealing element, so that, in said closed configuration, said sealing element engages with said groove, in order to form a labyrinth sealing. The prismatic shape of the matching allows a self-centering engagement of the movable element with respect to the fixed parts during the closure.

In particular, said groove is obtained at said movable wall portion, whereas said sealing element is arranged at an edge of said opening.

Alternatively, said groove is obtained on said edge of said opening, whereas said sealing element is arranged on said movable wall portion.

In a preferred exemplary embodiment, two grooves are provided parallel to each other that engage with two corresponding sealing elements, in particular gaskets of rubber or other material.

Advantageously, said movable wall portion comprises an end portion which protrudes upwardly with respect to said upper wall of said box-like container, in particular between said end portion and said movable wall portion a weakened zone is defined. This way, the end portion which protrudes above, in the closed configuration, with respect to the box-like container forms a protruding edge that assists the fluid-tight connection of the movable wall with respect to the container. Furthermore, the weakened zone that divides the end portion with respect to the movable wall portion allows that, if a heavy debris hits the end portion it breaks in the weakened zone, absorbing energy as energy of break, limiting the propagation of the hit to the remainder of the movable wall that would cause, for example, a partial opening of the protection cell.

Advantageously, a lock means is provided, in particular of mechanical type, which is arranged near said opening in such a way that, in said closed configuration, a releasable locking is obtained between said movable wall portion and said box-like container.

In particular, said lock means is a quick releasable click closure comprising a clasp element and a fastening element that are arranged to engage with each other, in order to provide a releasable connection.

Advantageously, said clasp element and said fastening element are arranged respectively near said opening and near said movable wall portion, or vice-versa. This way, the user from the inside of the shelter space in the closed configuration of the protection cell can engage the clasp element with the respective fastening element obtaining a steady closure of the movable wall portion with respect to the box-like container.

Advantageously, said protection cell provides at least one air vent arranged at one of said walls. In particular, air vents are provided on each side wall.

Advantageously, said air vent is a vent that can be opened manually and comprises a plurality of apertures adjacent to each other, and a closure portion sliding by means of a guide, that is arranged to open/close completely or partially said apertures. This way, the user can adjust an inlet and outlet air flow into/from the protection cell.

In addition, said protection cell provides at least one check valve for the flow of air from the inside towards the outside of the protection cell. In particular, a check valve is provided on each wall of the protection cell as well as on said movable wall portion.

In particular, said check valve is mounted at a respective hole and comprises a dome-shaped coating element having a plurality of holes, in particular arranged perimetrally, and a stopper connected to said dome-shaped coating element by means of an elastic element, such that when in to said protection cell the pressure is identical or less than the external pressure, said stopper remains in a normally closed position to stop said hole, whereas when in said protection cell the pressure is higher than the external pressure said stopper disengages from said hole and allows an inlet and outlet air flow.

This way, the rescuers have the time for determining from the outside the is position of the protection cell and the user can remain inside owing to the supply of oxygen, communicating with the outside.

Advantageously, a survival kit is provided arranged within said shelter space of the box-like container, said survival kit comprising for example parts such as:

an oxygen cylinder;

a means for determining the position of said protection cell, in particular a GPS detector in addition to a sender/receiver, a utility/emergency light;

first-aid kit and long term food kit.

This way, the parts present in the kit allow to supply oxygen to the person in the protection cell by the oxygen cylinder, to make as far as possible comfortable the stay inside by the emergency light in addition to determine the position of the protection cell by a position detector.

In particular, the above described protection cell is made in the form of modules to contain a single user, that can be assembled, to provide different structures such as a table desk, a dining room table, a single bed, a double bed, etc.

In a first particular exemplary embodiment, said protection cell is a modular portion which is made in the form of a table and comprises a sitting board pivotally connected to the inner edge of the movable wall portion and that is arranged to move from a rest configuration, where the sitting board is substantially parallel to the movable wall portion, to a use configuration, where said sitting board is substantially orthogonal to the movable wall portion, so that a user can sit on it. This way, in the open configuration of the protection cell, the user can sit on the sitting board arrangement with legs within said shelter space of the box-like container and use the upper wall as desktop. Alternatively, an auxiliary table can be mounted on the upper wall such that the protection cell, according to the invention, acts as lower support. When the protection cell is used as table for example as school desk, in case of earthquake, more than one air vent can be opened, if the dangerous parts are solid (bricks, debris, etc.).

In a second exemplary embodiment, the protection cell is a modular portion which is made in the form of a bed, and in this case, the opening is is made on the edge along the cell. In this case, by assembling at least one module it is possible to form an upper wall as the size of a single bed or double bed.

In a third exemplary embodiment, the protection cell is a modular portion which is made in the form of lifeboat that can be used in watercrafts or alternatively, in case of flood, or other calamity in the presence of liquid. In this case, when the protection cell is used as lifeboat or in case of flood, tsunami, it has to be closed hermetically outwards. In this case the person can breath inside by the oxygen cylinder and by the check valves, until the cell does not achieve a stable position. For example if the cell is involved in a flood, or in case of tsunami, it can roll and/or translate dragged by the water up to reaching a stable position. During the movement the cell has to be closed hermetically and the sheltered person can breath with the oxygen and check valves. When the cell stops in a substantially steady position the person can breath through the air vents, that can be opened manually, which allow the inlet and the outlet of fresh air.

In a fourth exemplary embodiment, the protection cell is a modular portion which is made in the form of a fuselage or portion of fuselage of an aircraft in which a cabin is obtained within which the passengers can be accommodated.

In a fifth exemplary embodiment, the protection cell is a modular portion which is made in the form of cabin of a vehicle, in particular of a car that defines the cabin within which the passengers and the driver can be accommodated.

In a sixth exemplary embodiment, the protection cell is a modular portion which is made in the form of carriage or portion of carriage of a train or underground train.

In particular, the box-like container and the movable wall portion are made of a composite multi-phase, stratified and fibrous material. The material to is resistant, light and formable, as well as structurally capable of resisting to relevant loads such as those due to collapse of floors and/or walls. Furthermore, the above described material resists correctly to fire and to explosions in which the cell can be involved.

BRIEF DESCRIPTION OF THE DRAWINGS

The invention will be now shown with the following description of some exemplary embodiments, exemplifying but not limitative, with reference to the attached drawings in which.

Figure 8:
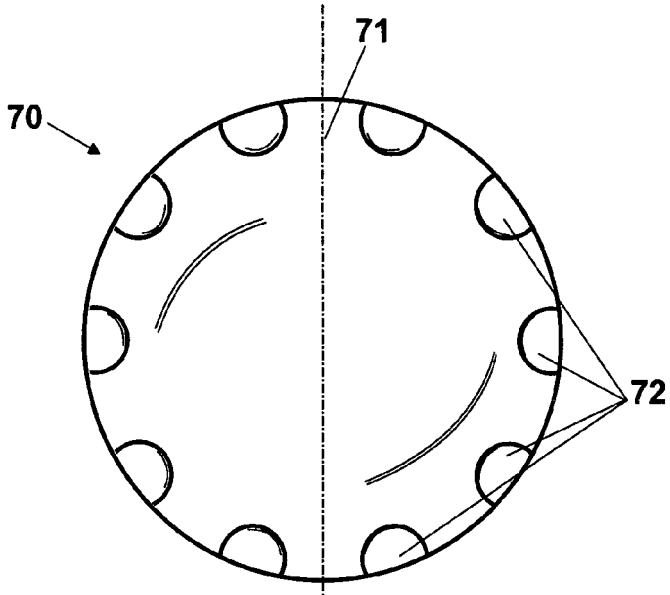
Figure 8A:
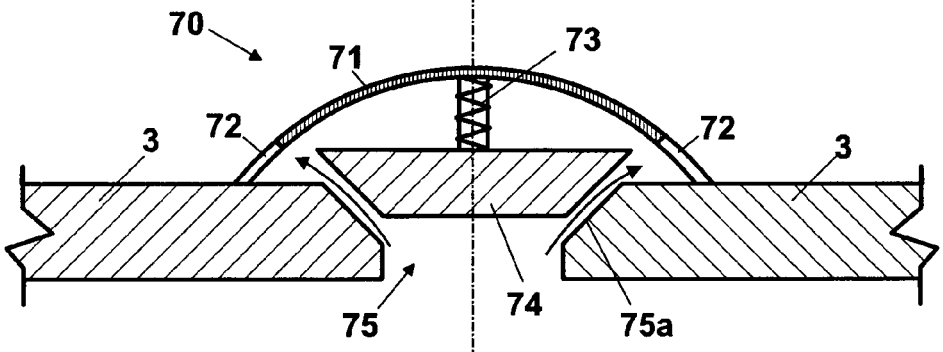
Figure 8B:
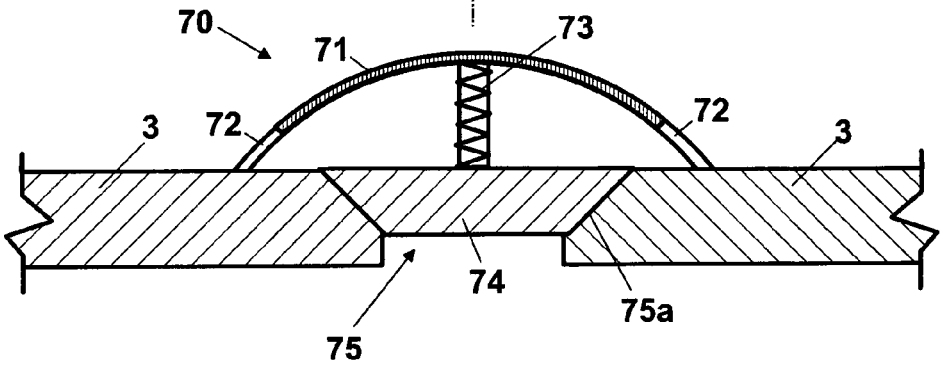
Figure 9:
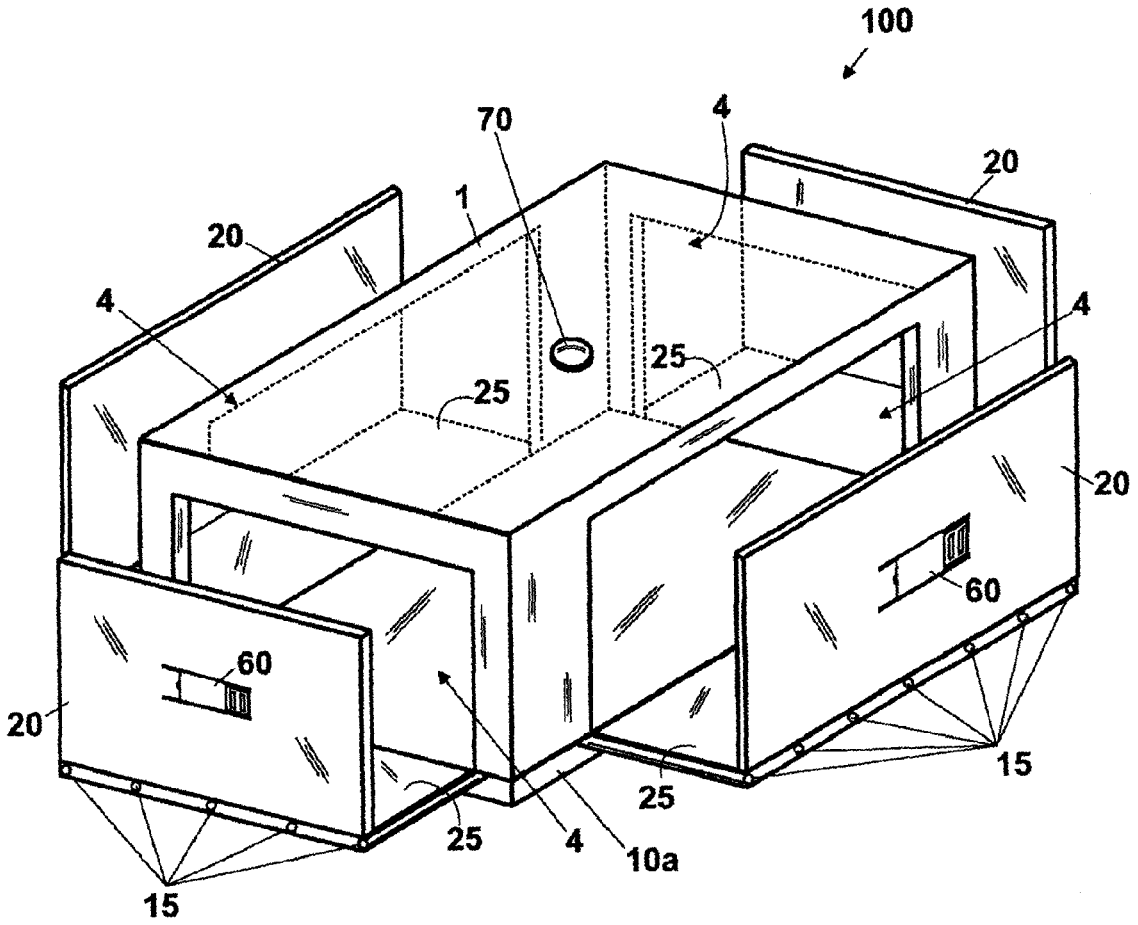
Figure 10:
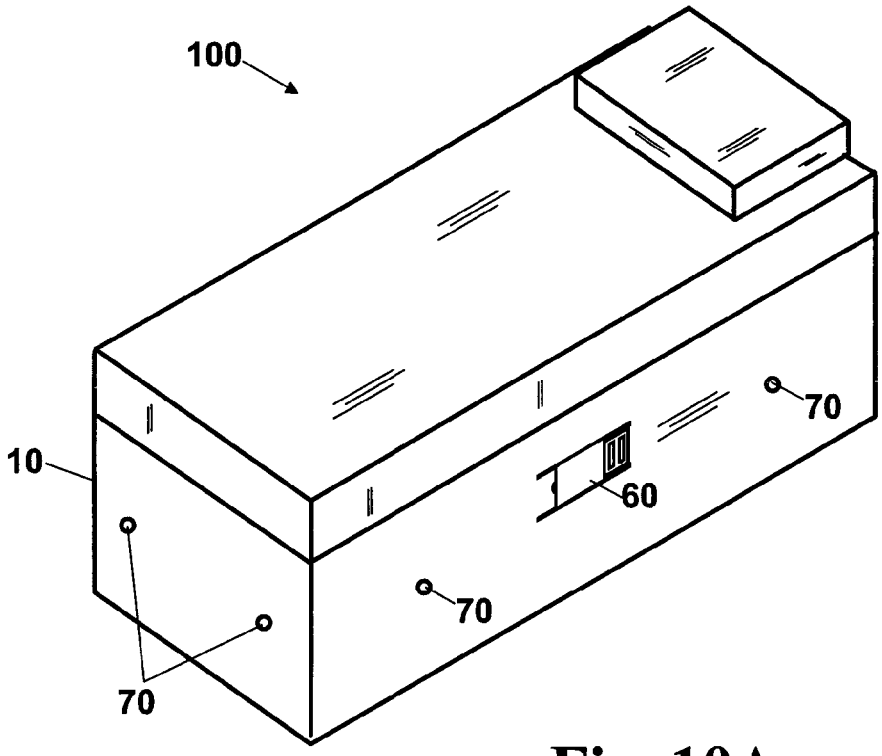
Figure 10A:
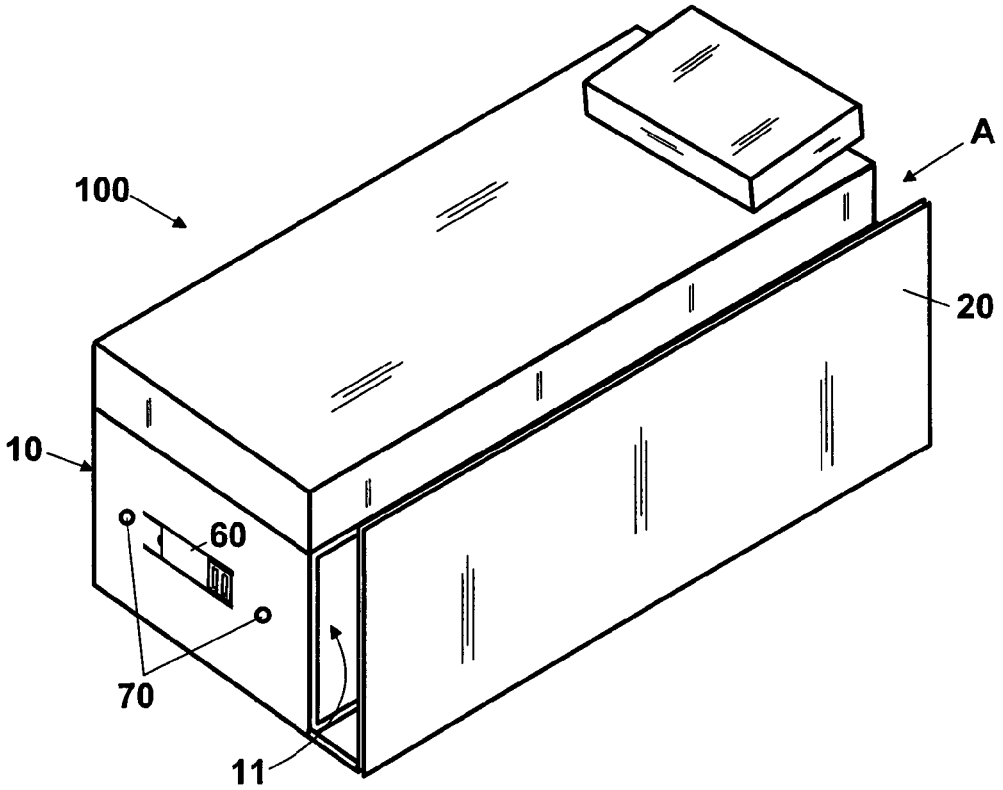
Figure 11:
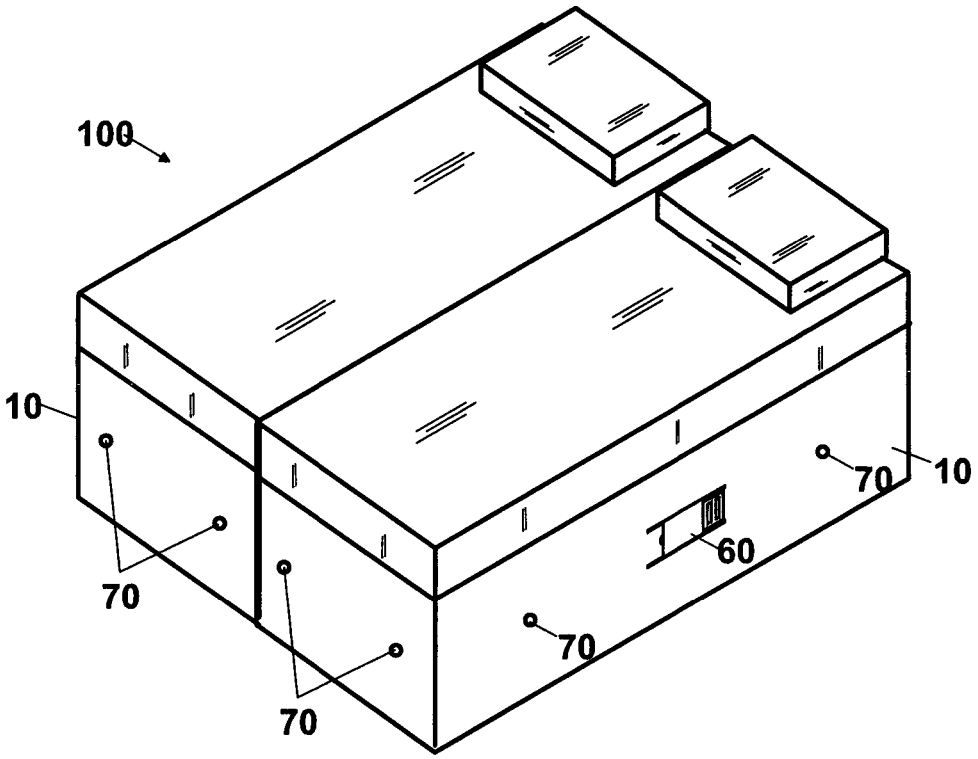
Figure 12:
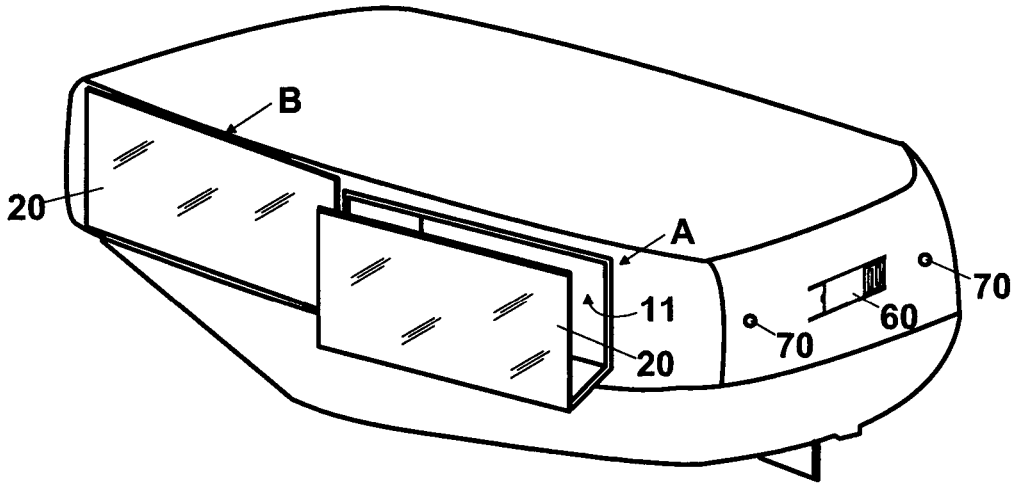
Figure 13:
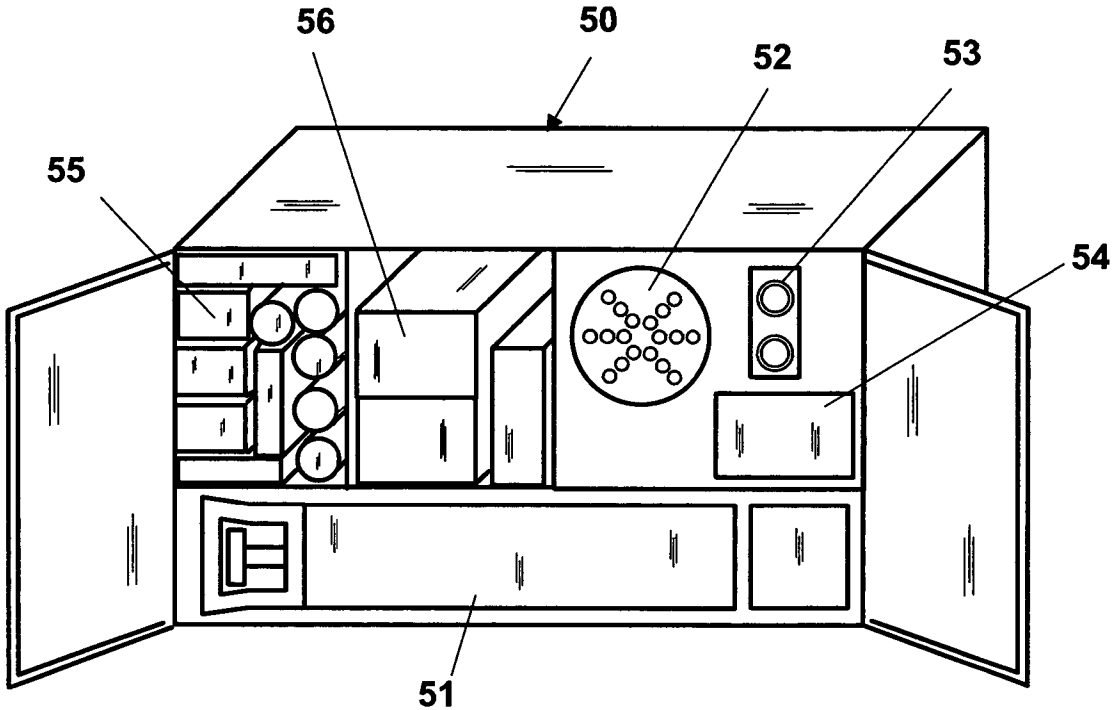
Figure 14:
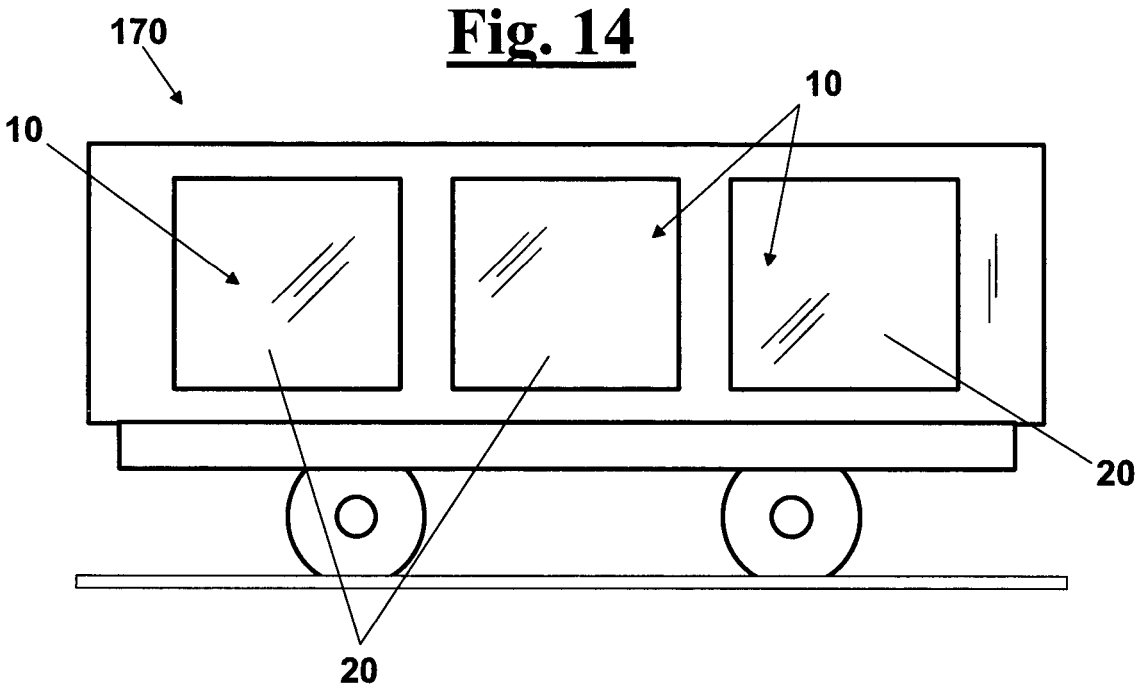
Figure 14A:
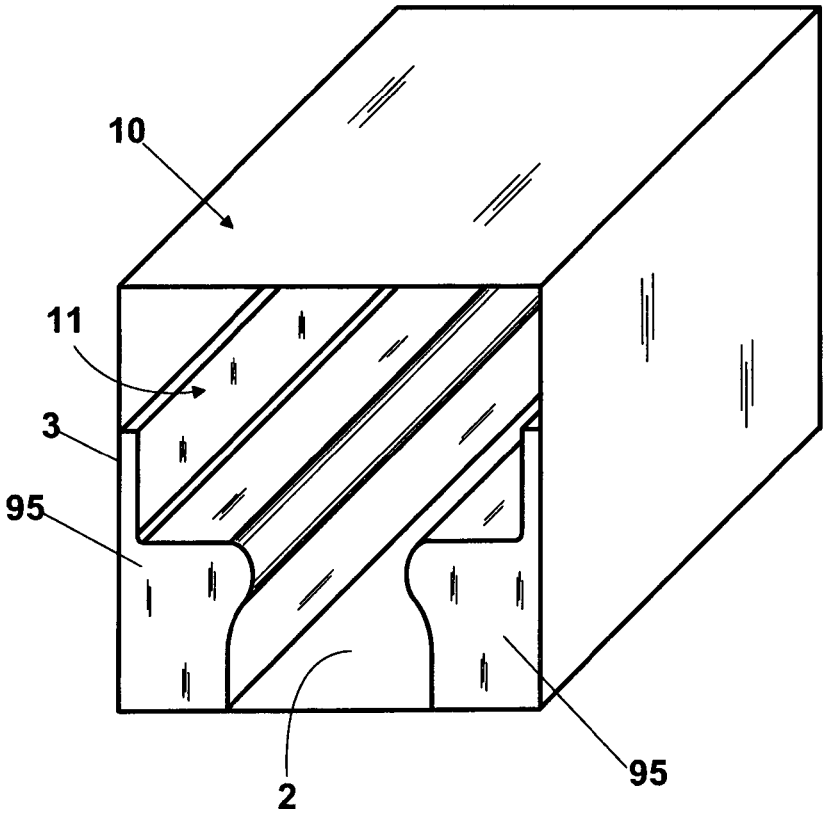
Figure 15:
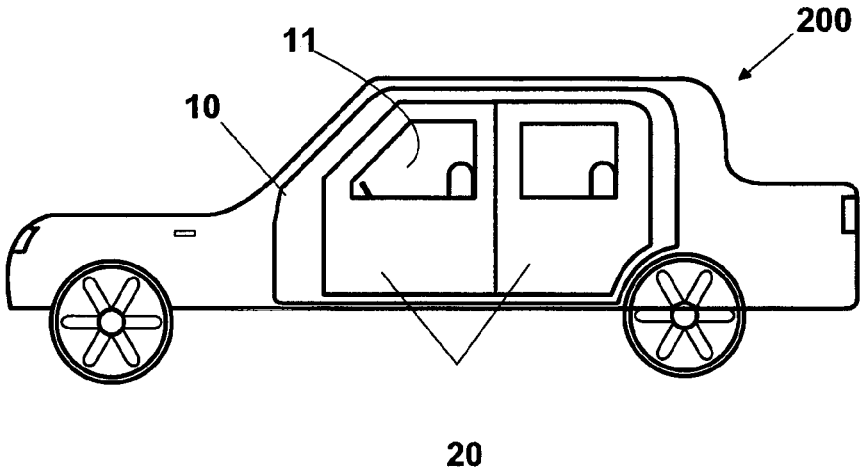
Figure 16:
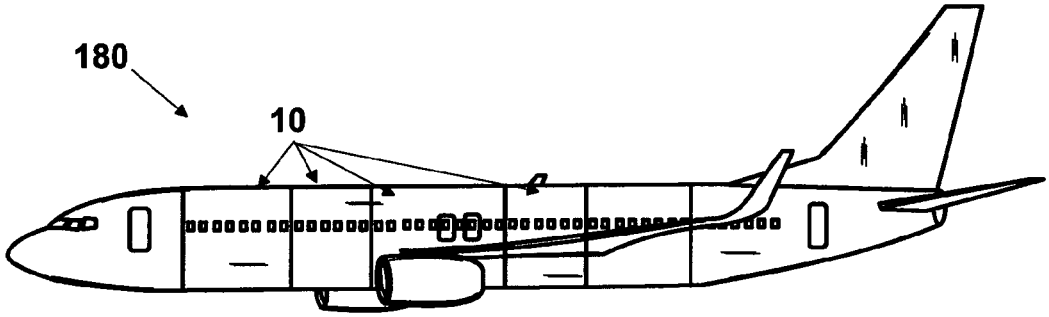
Figure 16A:
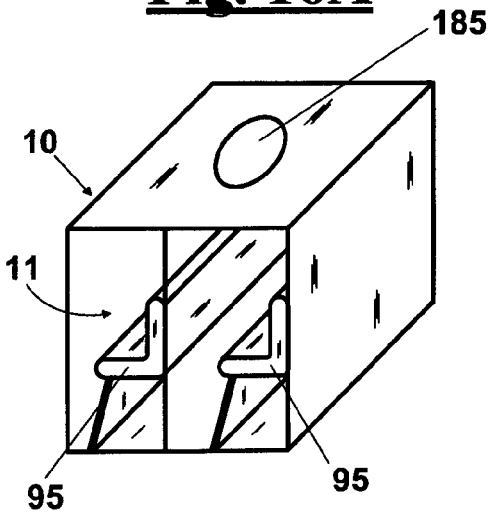

FIGS. from 7 to 7B show diagrammatically an air vent respectively in a closed, open or intermediate configuration, which is arranged on at least one wall of the protection cell;

FIGS. 8, 8A and 8B show diagrammatically a check valve for the movement of air from inside outwards of the protection cell;

FIG. 9 shows an exemplary embodiment of the protection cell in the form of a mobile wall and comprising four movable walls obtained on each side to face;

FIGS. 10 and 10A show a perspective view of an exemplary embodiment of the protection cell made in the form of a modular portion which reproduces a single bed respectively in the closed configuration and in the open configuration;

FIG. 11 shows a perspective view two modules of FIG. 10 coupled to each other, in order to form a double bed;

FIG. 12 shows a perspective view of an exemplary embodiment of the protection cell in the form of lifeboat;

FIG. 13 shows a diagrammatical view that reproduces an emergency kit arranged in the protection cell;

FIGS. 14 and 14A show in a diagrammatical view respectively a carriage for passengers (FIG. 14), and a protection cell which defines the carriage or a portion thereof (FIG. 14A) for a train or a underground train;

FIG. 15 shows a perspective view of an exemplary embodiment of the protection cell which defines the inner body of a car in which a cabin is made;

finally, FIGS. 16 and 16A show a perspective view of an aircraft (FIG. 16) comprised of several protection cells (FIG. 16A), each of which is a modular portion which is made in the form of a fuselage or portion of fuselage of an aircraft in which a cabin is obtained within which the passengers can be accommodated.

DESCRIPTION OF A PREFERRED EXEMPLARY EMBODIMENT

Figure 1:
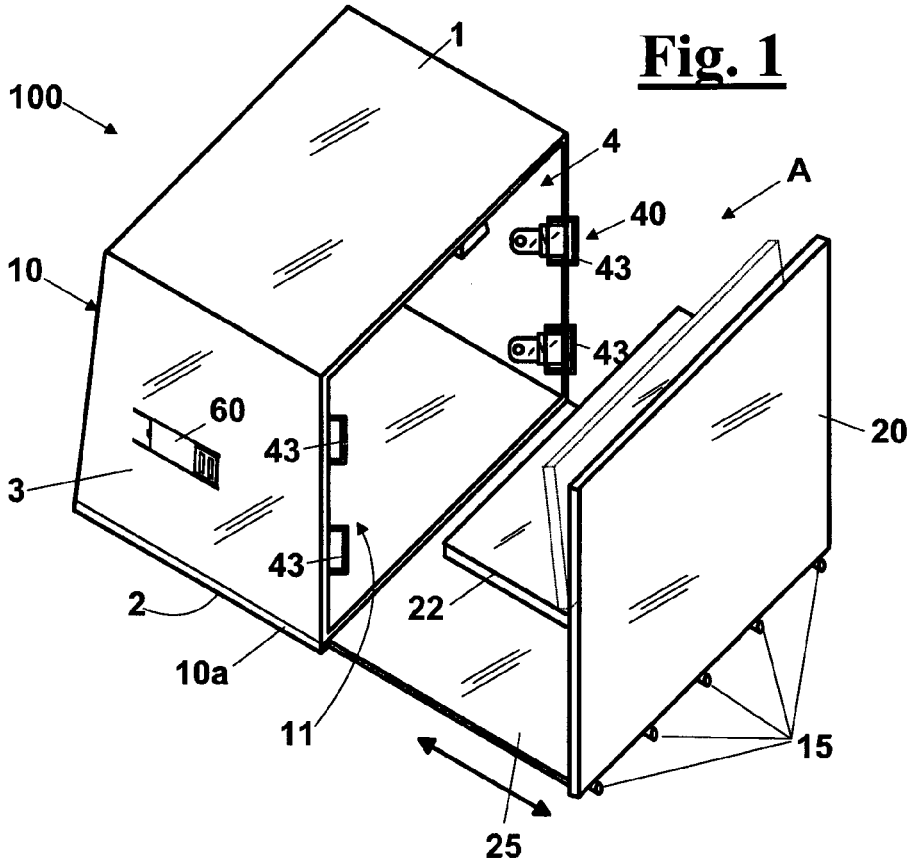
FIG. 1 shows a perspective view of a protection cell, according to the invention, in the form of a desk or school desk.

With reference to FIG. 1, a protection cell 100 is shown, according to the invention, in particular a anti-seismic cell used by a user as shelter during an earthquake.

In particular, protection cell 100 comprises an upper wall 1 and a lower wall 2 spaced with respect to each other through a plurality of side walls 3 integrally connected to each other, in order to form substantially a open box-like container 10 with at least one opening or entrance opening 4. Box-like container 10 defines inside a shelter space 11 that is arranged to accommodate at least one user 150, visible in FIG. 2 or 4.

In particular, container 10 can be made by assembling the walls to each other, but preferably is produced as a single block that reproduces the open box-like container 10, for example for injection moulding or for rotational moulding.

The anti-seismic cell 100 comprises, furthermore, a movable wall portion 20 cooperating with box-like container 10 that is arranged to block opening 4. In case there are more apertures 4, as shown in FIG. 9, at each of these a corresponding movable wall portion 20 is arranged. In a further alternative exemplary embodiment, not shown, a single movable wall portion 20 can stop more apertures 4 arranged adjacent to each other.

Always with reference to FIGS. 1-4, in particular movable wall portion 20 is mounted slidingly on box-like container 10 by means of a sliding cooperating element 25 mounted substantially orthogonal to movable wall portion 20. More precisely, the cooperating element is a plane sliding board 25 that slidingly engages between at least two slide paths 15, which are arranged at opposite sides with respect to each other, and mounted on lower wall 2. In particular, plane sliding board 25 faces above or below with respect to lower wall 2. In the first case plane sliding board 25 enters slidingly within inner shelter space 11, in the latter case plane sliding board 25 is contained out of box-like container 10.

Figure 2:
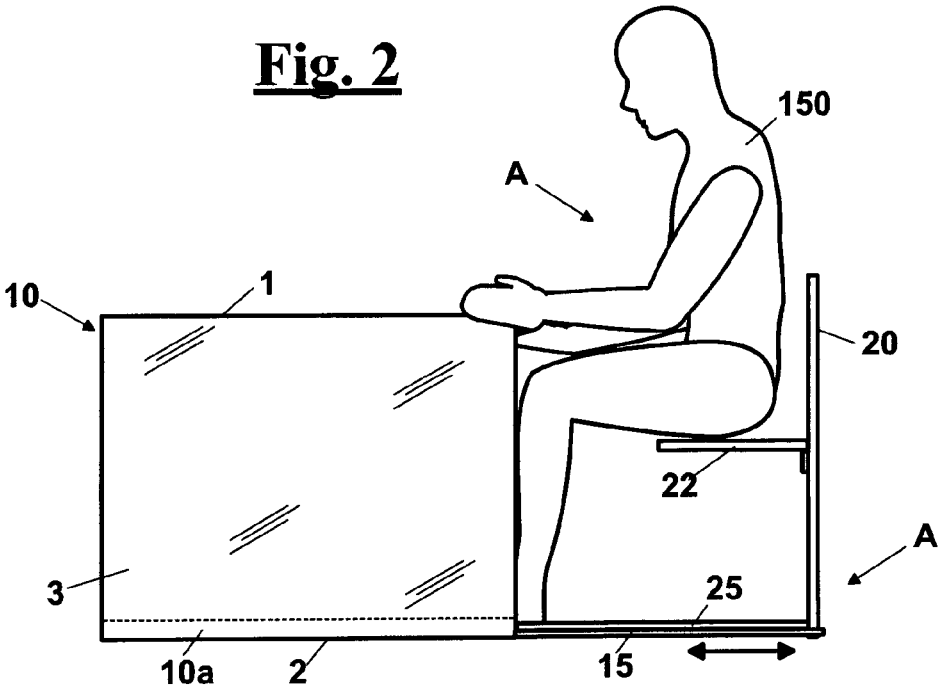
FIG. 2 shows an elevational side view of the protection cell of FIG. 1, with a user arranged in an open configuration which highlights the use of the school desko.
Figure 3:
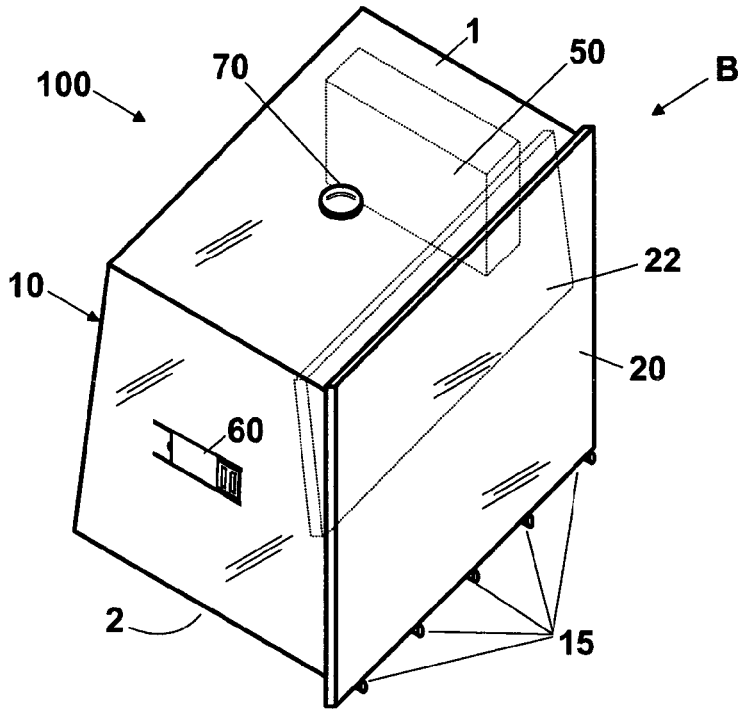
FIG. 3 shows a perspective view of the protection cell, according to the invention, in a closed configuration.

In particular, in an exemplary embodiment, as shown in FIGS. 1 and 2, plane sliding board 25 and slide paths 15 enter concealed within a space 10*a* obtained on the bottom of container 10. This way, the guide 15 and the sliding zone of plane sliding board 25 are protected from the outside ensuring each time the closure of movable wall portion 20. In particular, more slide paths 15 are provided spaced from each other, in order to ensure a higher precision to the relative movement between plane sliding board 25 and lower wall 2. Alternatively, in a way not shown, slide paths 15 can be arranged on upper wall 1 or on a side wall 3. In this case, the cooperating element 25 is respectively slidingly arranged on upper wall 1 or on one of side walls 3 and 4.

Plane sliding board 25 thus arranged allows movable wall portion 20 to move from an open configuration A (FIG. 1 or FIG. 2), where movable wall portion 20 opens opening 4, to a closed configuration B (FIG. 3 or FIG. 4), where movable wall portion 20 blocks opening 4 defining protection cell 100. In particular, this exemplary embodiment forms a substantially "drawer-like" structure where movable wall portion 20 remains always connected to box-like container 10 by plane sliding board 25. This way, in the open configuration A, entrance opening 4 is wider and does not create obstacle to the entrance of the user. Such solution is advantageous with respect, for example, to an opening where the movable wall is hinged to the side wall, since it does not provide side hinge fastening edges that would reduce the size of the opening same.

The exemplary embodiment of FIGS. 1, 2, 3 and 4 represents a protection cell in the form of desk or school desk. In this case, in fact a sitting board 22 is provided pivotally connected to movable wall 20 from inner side that faces towards opening 4 of box-like container 10. In open configuration A, as shown in FIG. 2, sitting board 22 is arranged substantially orthogonal with respect to movable wall 20 so that user 150 can sit on it, putting the lower limbs within shelter space 11 of container 10. When passing from the open configuration A, to the closed configuration B (FIGS. 3 and 4), sitting board 22 rotates with a known mechanism, not shown, in order to be put parallel to movable wall 20 and to minimize the encumbrance within shelter space 11. User 150, once entered box-like container 10 is put in a tuck position within shelter space 11 (FIG. 4) and pulls movable wall portion 20 that slides integral to the plane sliding board 25, in order to stop opening 4.

Figures 5, 5A:
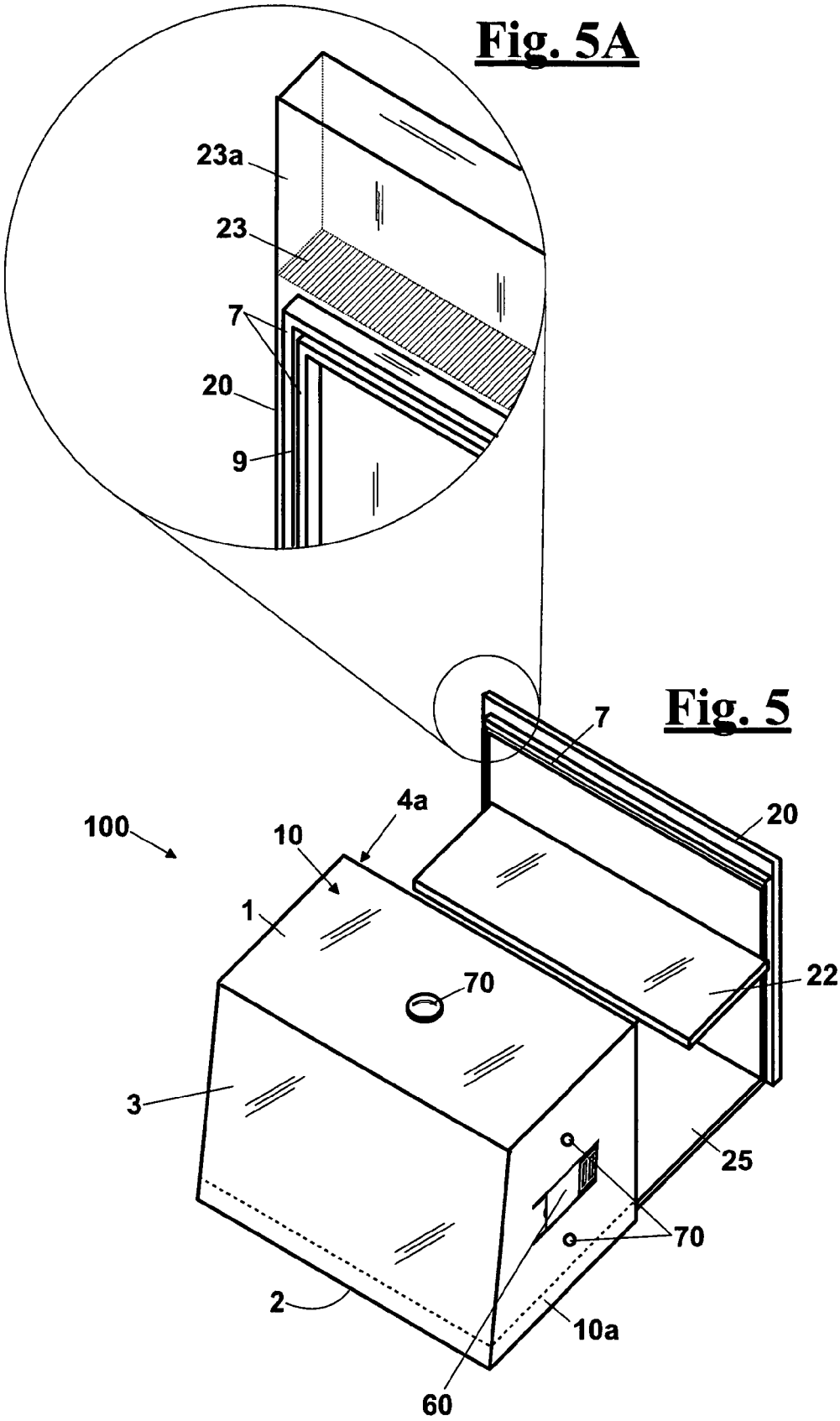
FIG. 5 shows a perspective view of the protection cell from the inside of the mobile wall, whereas the enlarged view of FIG. 5A shows the sealing means arranged on the mobile wall.
Figure 5B:
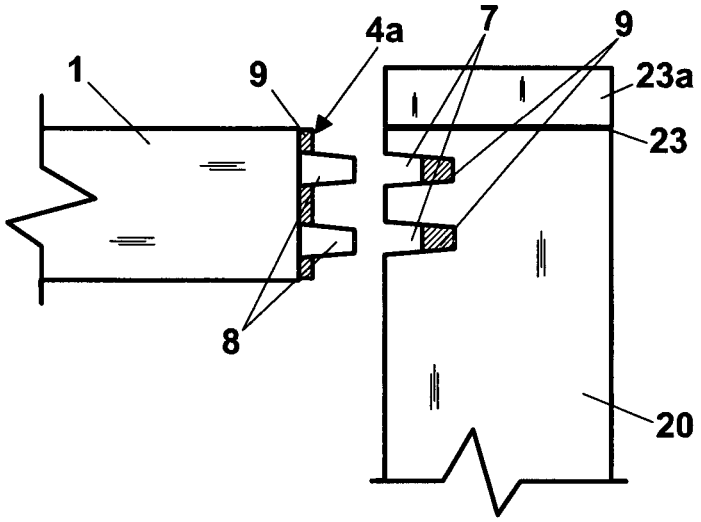
FIGS. 5B and 5C show diagrammatically two different exemplary embodiments of the sealing means arranged on the movable wall and on the box-like container of the protection cell.
Figure 5C:
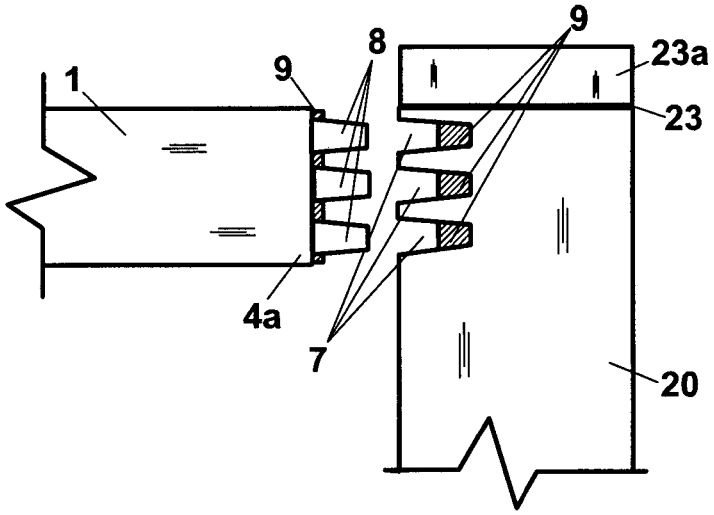

In particular, as shown in FIG. 5 and in the enlarged view 5A, the matching between movable wall portion 20 and free edge 4*a*, as also shown in the exemplary embodiments of FIGS. 5B and 5C, at opening 4 is a sealed coupling that ensures a fluid tight engagement outwards. This is made through a sealing means that comprises at least one groove 7 (FIG. 5A) and a respective sealing element 8 that engages with groove 7 (FIG. 5B or 5C).

In particular, as diagrammatically shown in FIGS. 5B and 5C, grooves 7 are obtained peripherally at movable wall 20 and a respective sealing element 8 is arranged peripherally at the edge 4*a* of the opening. In detail, grooves 7 and the respective sealing element 8 have tapered cross section such that in the mutual matching a self-centering of movable wall portion 20 is allowed with respect to box-like container 10, assisting the closure. In particular, in the closed configuration B, sealing element 8 engages in the groove 7 penetrating it, in order to form a labyrinth sealing. In a preferred exemplary embodiment, as shown in FIG. 5C, three grooves 7 are provided parallel to each other where with fixed joint three corresponding sealing elements 8 engage. Sealing elements 8 can be made as seal gaskets, for example rubber, directly engaging with grooves 7, or as protruding elements 8 of stiff material that engage with fixed joint in a respective groove 7. In the latter case, at grooves 7 and protruding elements 8 auxiliary seals gaskets 9 are provided, in particular rubber seals or other material. They are respectively arranged at the bottom of grooves 7 and at the bottom of protruding elements 8, as shown in FIG. 5B.

In particular, movable wall portion 20 comprises an end portion 23*a* that protrudes upwards with respect to the plane defined by upper wall 1 of box-like container 10. In particular, protruding end portion 23*a* is defined by a weakened zone 23, as shown in FIG. 5A with a dashed line. Such solution allows, if a block or other debris hits the cell, it hits before protruding end portion 23*a* of movable wall 20 without damaging movable wall portion 20 and the fluid tight connection between the latter and box-like container 10. In other words, weakened zone 23 is arranged to cause the break of sole end protruding portion 23*a* and not movable wall portion 20 that blocks opening 4. This way, the safety of user 150 in protection cell 100 is further ensured.

Figures 6, 6A:
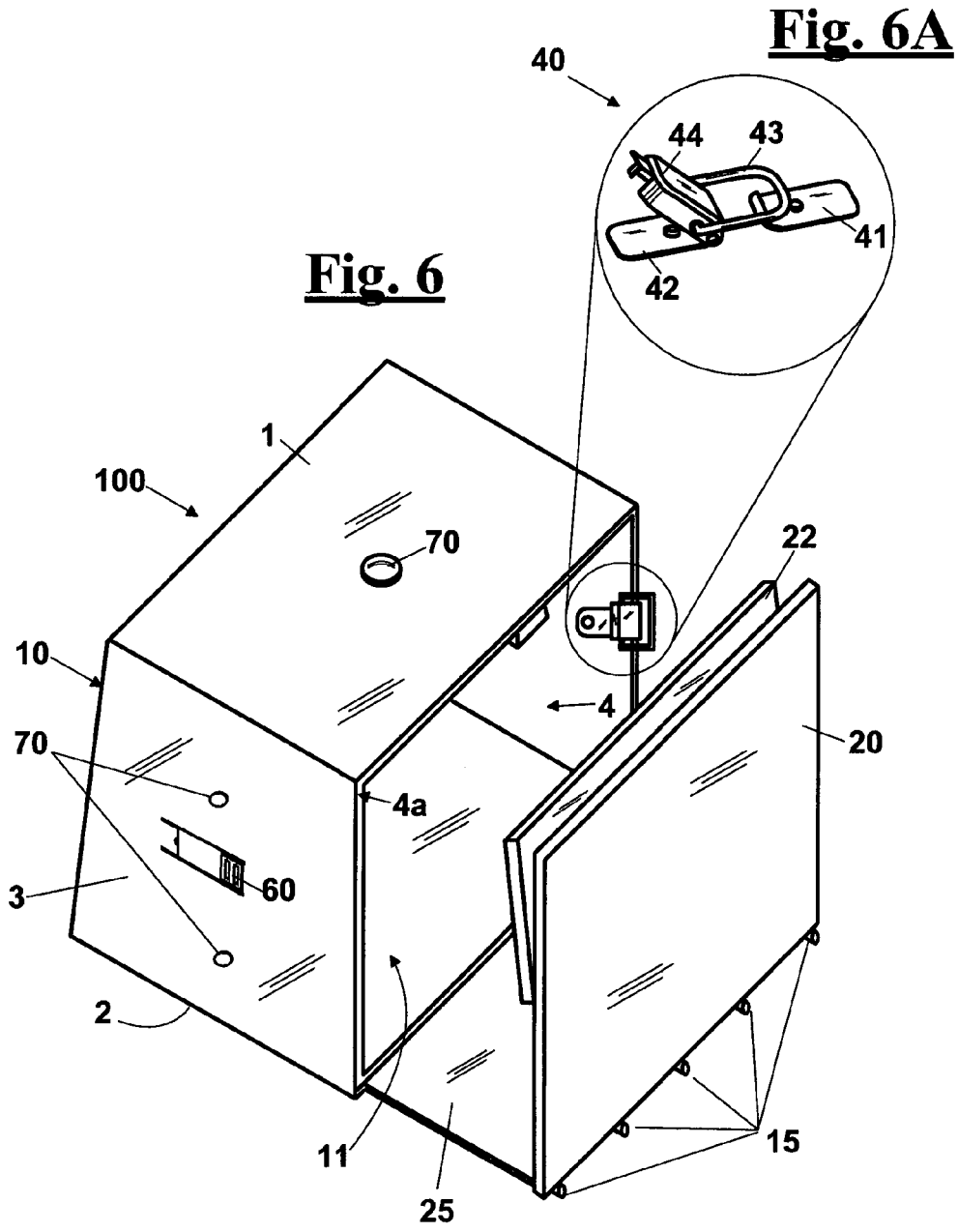
FIG. 6 and the respective enlarged view of FIG. 6A show a click closure mechanism that is arranged to fix the movable wall with respect to the box-like container.

To provide a hermetic closure of movable wall 20, furthermore, a lock member 40 is provided, in particular of mechanical type, which is located in box-like container 10 (FIG. 6A). In particular, several lock members 40 or click elements are provided at a distance from each other and arranged at the inner side of side wall 3 near opening 4. In detail, as shown in FIG. 6B, each lock member 40 comprises a fastening plate 41 integral to movable wall portion 20 and a clasp plate 42 mounted protruding on side wall 3, at respective fastening plate 41. In particular, clasp plate 42 comprises a hook 43 that engages with fastening plate 41 operated by a lever mechanism 44 of hook 43 that makes it possible a stable closure, thus applying on fastening plate 41 and then on movable wall portion 20 a pulling action which achieves a steady closure of movable wall portion 20. The above described features of protection cell 100 allow to obtain a hermetic sealing even against leakage of fluids or gas, owing to the labyrinth sealing system and to mechanical lock members 40.

This way, once approached movable wall portion 20 to opening 4, user 150 can acts from inside on lock members 40 that are easy and fast to operate and ensure an effective closure of movable wall portion 20, and a full insulation with the labyrinth sealing.

Further characteristic of protection cell 100, according to the invention, relate to air vents 60 (as shown in FIGS. 1, 3, 5, 6), in particular on each side wall 3 as well as on upper wall 1 and lower wall 2 of protection cell 100 as well as on movable wall portion 20.

Figure 7:
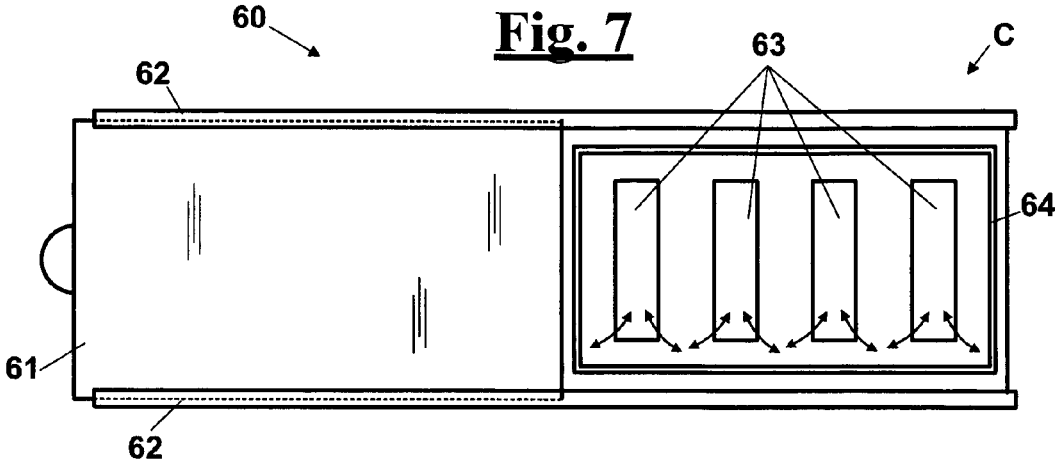
Figure 7A:
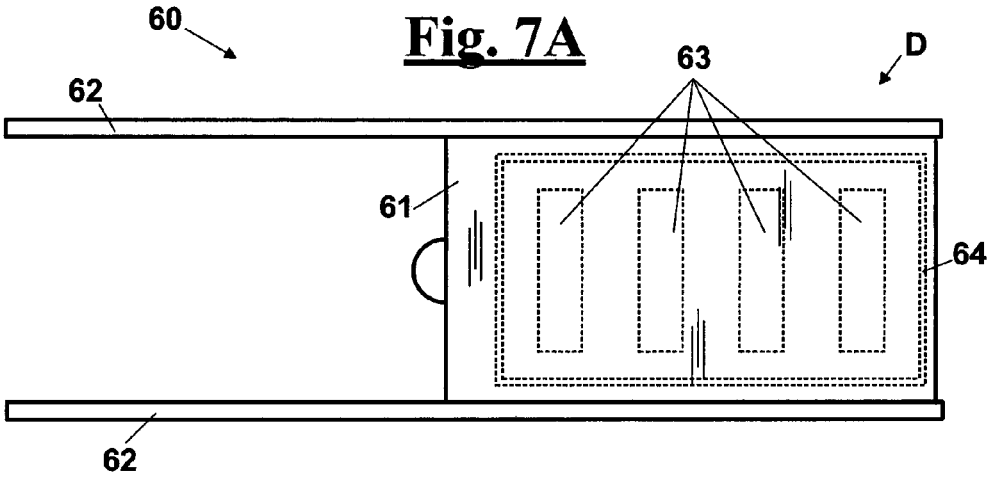
Figure 7B:
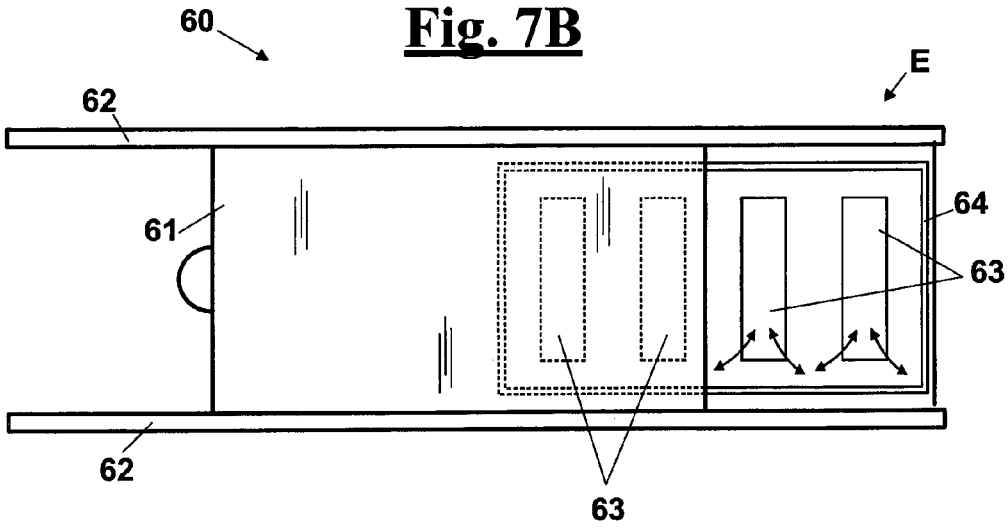

In particular, each air vent 60, as shown in FIGS. 7, 7A and 7B, is a vent that can be opened manually and comprises a plurality of apertures 63 adjacent to each other and a closure portion 61 sliding by means of a guide 62 that is arranged to open/close completely or partially the series of apertures 63. This way, it is possible to move from an open configuration C, where all apertures 63 of air vent 60 are open (FIG. 7), to a closed configuration D, wherein all apertures 63 of air vent 60 are closed (FIG. 7A), or to a intermediate configuration where closure portion 61 blocks a part of apertures 63 (FIG. 7B). This way, the user can adjust a protection cell inlet and outlet air flow.

In particular, apertures 63 are inserted within a sealing frame 64 comprising a protruding seal member that touches closure portion 61 when this is overlapped to apertures 63, in order to make, also in this case, a hermetic closure. Air vents 60 allow the user to breath and let air pass from the outside. If this is not possible in box-like container 10 at least one oxygen cylinder 51 is provided (FIG. 13) for breathing in case of lack of air from the outside, as described.

In addition, on side walls 3 at least one check valve 70 (FIGS. 8, 8A and 8B) is provided, for movement of air from inside outwards from protection cell 100. In particular, a check valve is provided 70 in each wall of the box-like container as well as on movable wall portion 20.

In particular, each check valve 70 is mounted at a respective hole 75 and comprises a dome-shaped coating element 71 with a plurality of holes 72, in particular arranged perimetrally, and a stopper 74 connected to the dome-shaped coating element 71 by a resilient element 73, for example a spring. In detail, hole 75 has bent side walls 75*a*, whereas stopper 74 has a substantially tapered shape, in order to ensure a fluid tight engagement with hole 75 (FIG. 8B). This way, when in protection cell 100 the pressure is identical or less than the external pressure, stopper 74 remains in a normally closed position (FIG. 8B), in order to stop hole 75, when in protection cell 100 the pressure is higher than the external pressure, stopper 74 disengages from hole 75 and allows an air flow inlet and outlet, as shown in FIG. 8A.

In particular, protection cell 100, as shown in FIGS. from 9 to 12, can be made in the form of many objects. In addition to a table or school desk described above in FIGS. 1-6, protection cell 100 can provide a single box-like container (FIG. 9) with substantially prismatic shape 10 with four apertures 4 obtained on the respective side walls. In this case, such a protection cell can house inside more users that can access from a desired side of movable walls 20.

FIGS. 10 and 10A show instead protection cell 100 made in the form of a modular portion having the shape of a bed 130 that is arranged to contain a single user. In this case, movable wall portion 20 has a substantially elongated shape such that user 150 can move into relative shelter space 11 in a substantially lying position. The mechanism of opening movable wall portion 20, obtained on one of the side walls, as shown in FIG. 10A, is that described above.

Furthermore, by connecting each other two or more modules it is possible to obtain a double bed, as shown in FIG. 11, or more beds.

In a further exemplary embodiment, as shown in FIG. 12, protection cell 100 is a modular portion which is made in the form of lifeboat 140 that can be used in watercrafts or alternatively, in case of flood, or other calamity where liquids are involved. If the protection cell is used as lifeboat or in case of flood, or tsunami, it has to be closed hermetically. In this case, user 150 in shelter space 11 can breath through oxygen cylinder 51 comprised in survival kit 50, using check valves 70. For example, protection cell 100 could, for example being dragged away by floods, until it reaches a stable position. During the movement the cell has to be closed hermetically and user 150 breaths oxygen and uses check valves 70. When the cell stops the user can breath through air vents 60, that can be opened manually, which allow the inlet of external air.

The structure of protection cell 110 described above, related to the structure of box-like container 10 and of movable wall portion 20 in the closed configuration B, can bear high loads, resistant to fire and to explosions owing to the features of the material with which they are made. The latter is, in particular, a composite material multi-phase, stratified and fibrous, for example a composite material such as carbon fibre on epoxy base, which fulfils the resistance, lightness and workability and then production cost relatively low with respect to the function that it develops.

Such a structure ensures a full protection on all the sides of the cell, improved with respect the known structures that ensure a protection, in most cases, only on the upper wall.

Figure 4:
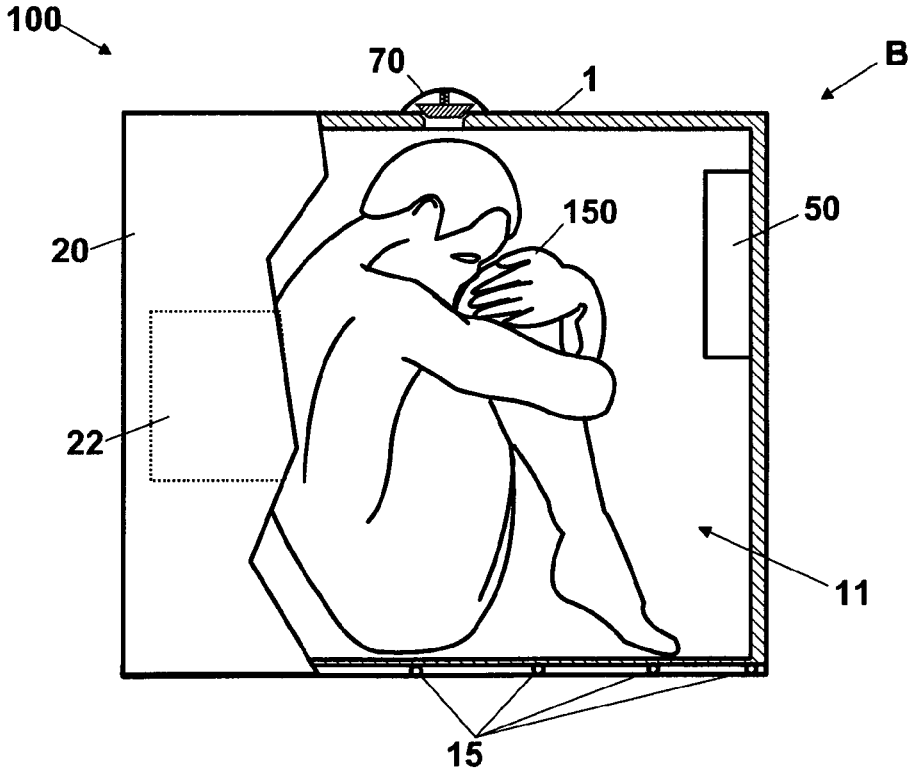
FIG. 4 shows an elevational side view of the protection cell in the closed configuration, with inside a user.

FIG. 13 shows an example of a survival kit 50 arranged within shelter space 11 of box-like container 10 (FIG. 4). In particular, the kit 50 has an oxygen cylinder 51, a utility/emergency light 52, a GPS detector 53 in addition to a sender/receiver 54. Furthermore, first-aid kit 55 is provided and a long term food kit long term food kit 56.

The parts present in survival kit 50 allow breathing in case of lack of oxygen in protection cell 100 by oxygen cylinder 51, of achieve a relatively comfortable stay inside by emergency light 52 in addition to determine the position of cell 100. This way, it is possible through receiver 54 to determine the position of the sheltered person in protection cell 100 as well as to transceive data from the outside and to assisting the first-aid treatment. Once in cell 100, the user can activate the breathing devices of survival kit 50 if the stay inside is long.

FIG. 14 shows the protection cell applied to carriage of a train or of a underground train 170. In this exemplary embodiment, at least one protection cell with a box-like container and of movable wall opening/closing member, that in this case is represented by the window of the carriage.

In particular, FIG. 14A shows in a simplified view without movable wall 20, a protection cell 110 where box-like container 10 defines a carriage for passengers for a train or a underground train or a portion of it. Within shelter space 11 of each box-like container 10 a plurality of seats is provided or a single multiple seat 95 on lower wall 2 or mounted to side walls 3 of the cell structure. Bottom wall 2 works walking ground for users.

A further application of the protection cell, as shown in FIG. 15, provides box-like container 10 to define the inner body of a car 200 in which a cabin is made. Even in this case, the inner shelter space 11 comprises seats 95 in to addition to all the further elements present in a common car. The doors of the car 200 define, in this case, movable board 20 of the protection cell, made as above described;

FIGS. 16 and 16A show a further application of the protection cell as modular portion which represents a fuselage of an aircraft 180 or a portion it. In the latter solution more protection cells of FIG. 16A are provided, which can be assembled to each other, in order to compose the fuselage of an aircraft (FIG. 16). Each protection cell 10 comprises seats 95 for passengers and doors or apertures that comprise the above described movable wall 20. Each cell can integrate further means for safety such as a parachute 185.

The foregoing description of a specific embodiment will so fully reveal the invention according to the conceptual point of view, so that others, by applying current knowledge, will be able to modify and/or adapt for various applications such an embodiment without further research and without parting from the invention, and it is therefore to be understood that such adaptations and modifications will have to be considered as equivalent to the specific embodiment. The means and the materials to realise the different functions described herein could have a different nature without, for this reason, departing from the field of the invention. It is to be understood that the phraseology or terminology employed herein is for the purpose of description and not of limitation.

The invention claimed is:

1. A protection cell (100) for use as an anti-seismic cell, said protection cell comprising:

an upper wall (1);

a lower wall (2) at a distance from said upper wall (1);

a plurality of side walls (3) integrally connected to each other and arranged between said upper wall (1) and said lower wall (2), in order to form substantially an open box-like container (10) comprising at least one opening (4) obtained at one of said walls, said box-like container (10) defining an inner shelter space (11) that is arranged to accommodate at least one user (150);

at least one movable wall portion (20) cooperating with said open box-like container (10) and that is arranged to block said opening (4), wherein said movable wall portion (20) is mounted slidingly on said box-like container (10) by means of a sliding cooperating element (25) arranged substantially orthogonal to said movable wall portion (20); and wherein a lock means (40) is provided which is arranged near said opening (4) in such a way that, in said closed configuration (B), a releasable locking is obtained between said movable wall portion (20) and said box-like container (10).

2. A protection cell (100), according to claim 1, wherein said box-like container (10) is a single block that comprises said opening (4) and defines said inner shelter space (11) for receiving the user (150).

3. A protection cell (100), according to claim 1, wherein said sliding cooperating element (25) is arranged to engage with at least one slide path (15) mounted on said upper wall (1) or lower wall (2), or on at least one side wall (3) of said box-like container (10), such that said box-like container (10) and said movable wall portion (20) are adapted to move from an open configuration (A), wherein said movable wall portion (20) opens said opening (4), to a closed configuration (B), wherein said movable wall portion (20) blocks said opening (4), defining said protection cell (100).

4. A protection cell (100), according to claim 1, wherein, at said opening (4), a sealing means is provided (8, 9) adapted to ensure a fluid tight engagement of said box-like container (10) in said closed configuration (B).

5. A protection cell (100), according to claim 1, wherein said movable wall portion (20) comprises an end portion (23*a*) that protrudes upwards with respect to said upper wall (1) of said box-like container (10).

6. A protection cell (100), according to claim 1, wherein the lock means is of a mechanical type.

7. A protection cell (100), according to claim 1, wherein said protection cell (100) provides at least one air vent (60) arranged on one of said walls.

8. A protection cell (100), according to claim 1, wherein said protection cell (100) provides at least one check valve (70) for the inlet and outlet air flow in the protection cell (100).

9. A protection cell (100), according to claim 1, wherein a survival kit (50) is arranged within said shelter space (11) of the box-like container (10), said survival kit (50) comprising at least one member selected from the group consisting of:

an oxygen cylinder (51);

a means for determining the position of said protection cell (100) in addition to a sender/receiver (54), a utility/emergency light (52);

a first-aid kit (55); and a long term food kit (56).

10. A protection cell (100), according to claim 1, wherein said protection cell (100) is made in the form of a modular portion selected from the group consisting of:

a table;

a bed (130) that is arranged to contain a single user (150);

a lifeboat (140) that can be used in watercrafts or alternatively, in case of flood, or tsunami;

a fuselage (180) or portion of fuselage of an aircraft in which a cabin is obtained within which the passengers can be accommodated;

a carriage (170) or portion of carriage implemented in a train or in a underground train;

a cabin of a vehicle (200) that defines the cabin within which the passengers and the driver can be accommodated.

11. A protection cell (100), according to claim 3, wherein said sliding cooperating element (25) is a sliding plane board (25) integral to said movable wall portion (20) that slidingly engages between two guides (15), which are arranged at opposite sides with respect to each other on said box-like container (10).

12. A protection cell (100), according to claim 4, wherein said sealing means (8, 9) comprises at least one groove (7) that is arranged to couple with a respective sealing element (8), in such a way that, in said closed configuration B, said sealing element (8) engages with said groove (7), in order to form a labyrinth sealing.

13. A protection cell (100), according to claim 5, wherein a weakened zone (23) is defined between said end portion (23*a*) and said movable wall portion (20).

14. A protection cell (100), according to claim 6, wherein said lock means (40) is a quick releasable click closure comprising a clasp element (42) and a fastening element (41) that are arranged to engage with each other, in order to provide a releasable connection.

15. A protection cell (100), according to claim 7, wherein said air vent can be opened manually and comprises a plurality of apertures (63) adjacent to each other and a closure portion (61) sliding by means of guide (62), that is arranged to open/close completely or partially said apertures (63), so that the user (150) can adjust inlet and outlet air flow of the protection cell (100).

16. A protection cell (100), according to claim 8, wherein a check valve is provided (70) on each wall (1, 2, 3) of the protection cell (100) as well as on said movable wall portion (20).

17. A protection cell (100), according to claim 16, wherein said check valve (70) is mounted at a respective hole (75) and comprises a dome-shaped coating element (71) having a plurality of holes (72), in particular arranged peripherally, and a stopper (74) connected to said dome-shaped coating element (71) by a resilient element (73), such that when in said protection cell (100), the pressure is identical or less than the external pressure, said stopper (74) remains in a normally closed position, which is suitable for stopping said hole (75), whereas when in said protection cell (100), the pressure is higher than the external pressure said stopper (74) disengages from said hole (75) and allows an inlet and outlet air flow.

18. A protection cell (100), according to claim 9, wherein the means for determining the position of said protection cell (100) is a GPS detector (53).

19. A protection cell (100), according to claim 10, wherein said table comprises a sitting board pivotally connected to the inner edge of the movable wall portion (20) and that is arranged to move from a rest configuration, where the sitting board is substantially parallel to the movable wall portion (20), to a use configuration, where said sitting board is substantially orthogonal to the movable wall portion (20), so that a user (150) can sit on it.

20. A protection cell (100), according to claim 10, wherein said movable wall portion (20) has a substantially elongated shape such that the user (150) can move into the shelter space (11) in a substantially lying position.

21. A protection cell (100), according to claim 10, wherein two or more modules are connected to each other to obtain a double bed.

22. A protection cell (100), according to claim 10, wherein the vehicle is a car.

* * * * *